US008726822B2

(12) United States Patent
Ramde

(10) Patent No.: US 8,726,822 B2
(45) Date of Patent: May 20, 2014

(54) VESSEL

(75) Inventor: Roar Ramde, Åsgårdstrand (NO)

(73) Assignee: Roar Ramde, Asgardstrand (NO)

( * ) Notice: Subject to any disclaimer, the term of this patent is extended or adjusted under 35 U.S.C. 154(b) by 119 days.

(21) Appl. No.: 13/497,516

(22) PCT Filed: Sep. 21, 2010

(86) PCT No.: PCT/NO2010/000344
§ 371 (c)(1),
(2), (4) Date: May 30, 2012

(87) PCT Pub. No.: WO2011/037474
PCT Pub. Date: Mar. 31, 2011

(65) Prior Publication Data

US 2012/0227652 A1 Sep. 13, 2012

(30) Foreign Application Priority Data

Sep. 22, 2009 (NO) ..... 20093038

(51) Int. Cl.
*B63B 1/00* (2006.01)

(52) U.S. Cl.
USPC ..... 114/61.28; 114/56.1

(58) Field of Classification Search
USPC ..... 114/56.1, 57, 61.26, 61.27, 61.28, 62, 114/66
See application file for complete search history.

(56) References Cited

U.S. PATENT DOCUMENTS 4,550,673 A * 11/1985 Ingvason ..... 114/61.28
5,598,802 A 2/1997 Ramde
5,701,835 A * 12/1997 Borseth ..... 114/61.27
5,711,239 A 1/1998 Ramde

OTHER PUBLICATIONS

International Search Report and Written Opinion mailed Dec. 16. 2010 in International Application No. PCT/NO2010/000344.

* cited by examiner

*Primary Examiner* — Lars A Olson
(74) *Attorney, Agent, or Firm* — Foley & Lardner LLP

(57) ABSTRACT

The invention relates to a ship of the displacement type with a Ramform™ hull that has a transom stern (100), a longitudinal length L in the design waterline plane (300), a base plane (400) parallel with the design waterline plane at a distance T corresponding to the design draught of the hull and including essentially sinusoidal waterlines (602), a sloping plane (200) that comprises the bottom of the after end of the ship and which extends from the transom stern (100) at the design waterline plane (300) to the base plane (400) at approximately L/2 and a bulge on each side along a considerable part of the length of the hull, terminating at the forward end of the hull ahead of the length L in a tongue-like bulb member (900). The relationship between the maximum beam B and the design draught T is considerably more than 7, preferably between 10 and 12, and where the bulges (901) form the bulb member (900) and aft towards L/2 have a transversal horizontal orientation from the surface of the hull and which from about L/2 rotate gradually downward 90 degrees into a vertical orientation so that the bulge (902) at the transom stern (100) lies below the sloping plane (200) and along the outer edges of the sloping plane, but within the maximum beam B and above the base plane (400).

7 Claims, 6 Drawing Sheets

VESSEL

The present invention relates to ship hull designs of the Ramform™ type, built with sinusoidal waterlines as described for example in NO 153560 (Ramde); NO 309131 (Ramde); U.S. Pat. No. 5,598,802 (Ramde); and U.S. Pat. No. 5,711,239 (Ramde).

More specifically, the starting point for the invention is a displacement hull of this type which has a transom stern, longitudinal length L in the design waterline plane, a base plane parallel with the design waterline at a distance T corresponding to the design draught of the hull and comprising essentially sinusoidal waterlines, a sloping plane comprising the bottom aft part of the ship, extending from the transom stern at the design waterline plane to the base plane at about L/2, and a bulge on each side and extending along a considerable part of the hull terminating at the forward end of the ship, forward of the length L, in a tongue-like bulb member.

Said earlier Ramform™ patents describe certain dimensional relationships that are now intended to be improved to a substantial degree. This applies to the basic hull configuration determined by the relation between the beam (B)/design draught (T).

NO 309131 describes a ship of the displacement type with a Ramform™ hull that has a transom stern, a longitudinal length in the design waterline plane and a base plane parallel with the design waterline plane at a distance corresponding to the draught of the hull. Furthermore, the hull includes essentially sinusoidal waterlines, a sloping plane that comprises the bottom in the after part of the ship and extends from the transom stern at the design waterline level to the base plane approximately half way along the hull. The hull also comprises a bulge on each side, extending along a considerable part of the hull, terminating ahead of the forward end of the length of the hull in a tongue-like bulb member. The ratio between the length and the beam may be less than 1.4.

In addition, new design features has also been found that involve significant improvements in the performance of hull shapes for ships constructed in accordance with earlier Ramform™ patents. It is especially pointed out here that U.S. Pat. No. 5,711,239 describes bulges that extend both horizontally and vertically out from the hull beyond its maximum beam B and below the base plane.

Against this background what is new and special about the ship according to the invention consists first and foremost of the relationship between the beam B and the design draught T being considerably larger than 7, preferably between 10 and 12.

The ratio (B/T) between the maximum beam B and the largest design draught (T) provides the basis for further improvements in the form of features defined by the patent claims 2-5, relating to the bulges, the bulb member and the skeg location.

Whilst previously known Ramform™ hulls were unusually broad in relation to their length, the above new solution involves a considerable and radical increase in the beam/draught relation. It has become apparent, surprisingly, that a new hull configuration, which almost goes against traditional theory and specialist knowledge, brings about new and advantageous characteristics.

The sea-keeping qualities of the hull configurations according to the present invention will thus be improved through geometrical changes of the beam of the hull with respect to its draught and in connection with these relationships a lengthening and twisting of the bulges in the hull, including the termination of the bulges in the forward part of the ship, in the form of a projecting bulb member that ends above the design waterline plane. The aftermost parts of the bulges terminate below the sloping plane towards the outer edges of the transom stern, causing the rolling movements of the hull, and the associated levels of acceleration to be reduced and the propulsion characteristics improved in comparison with previous Ramform™ hulls. The advantages achieved include maintaining the comparatively low resistance in the sea at varying speed.

According to the invention the above advantages and other favorable effects will be achieved in a hull form where the combination of construction features to some extent including features that are already known about per se, also includes increasing the beam of the hull whilst maintaining the length of the hull and draught in such a combination that a bulge formed on each side of the hull along a part of the hull in contact with water from around the bow to around the transom stern, has essentially constant dimensions at the bow and the aft to about L/2 thwartship, with horizontal orientation from the surface of the hull. From about L/2 the orientation is rotated gradually to vertical 90 degrees down towards the base plane so that the bulge at the transom stern lies below the sloping plane and at the outer edges of the said sloping plane, but inside the greatest beam B and above the base plane.

Further, the two bulges, each on its own side of the hull, can continue forward and then come together in the upward sloping bulb member, which breaks through the design waterline and terminates above it.

The invention will be described below by referring to the drawings, in which the embodiments shown are provided purely by way of example. It is not intended for them to imply any limitation of the invention to particular features or combinations, as will be obvious to a person skilled in the art. The drawings shows:

Figure 1:
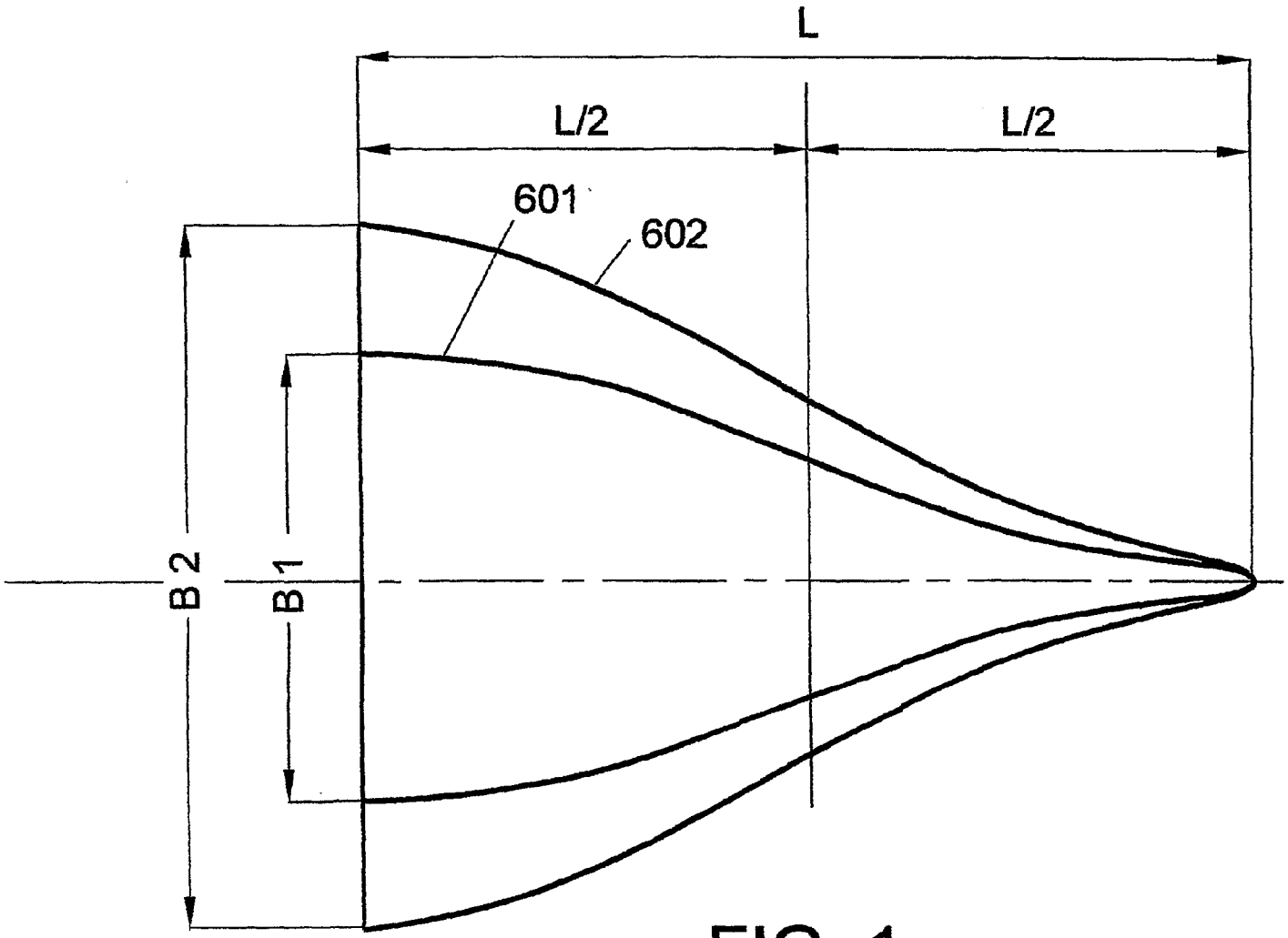
FIG. 1 shows a plan view of two different hull configurations of the Ramform™ type.

Reference is now made to FIG. 1 where a sinusoidal waterline 601 with maximum beam B1 represents prior art Ramform™ designs in accordance with the invention.

Figure 2:
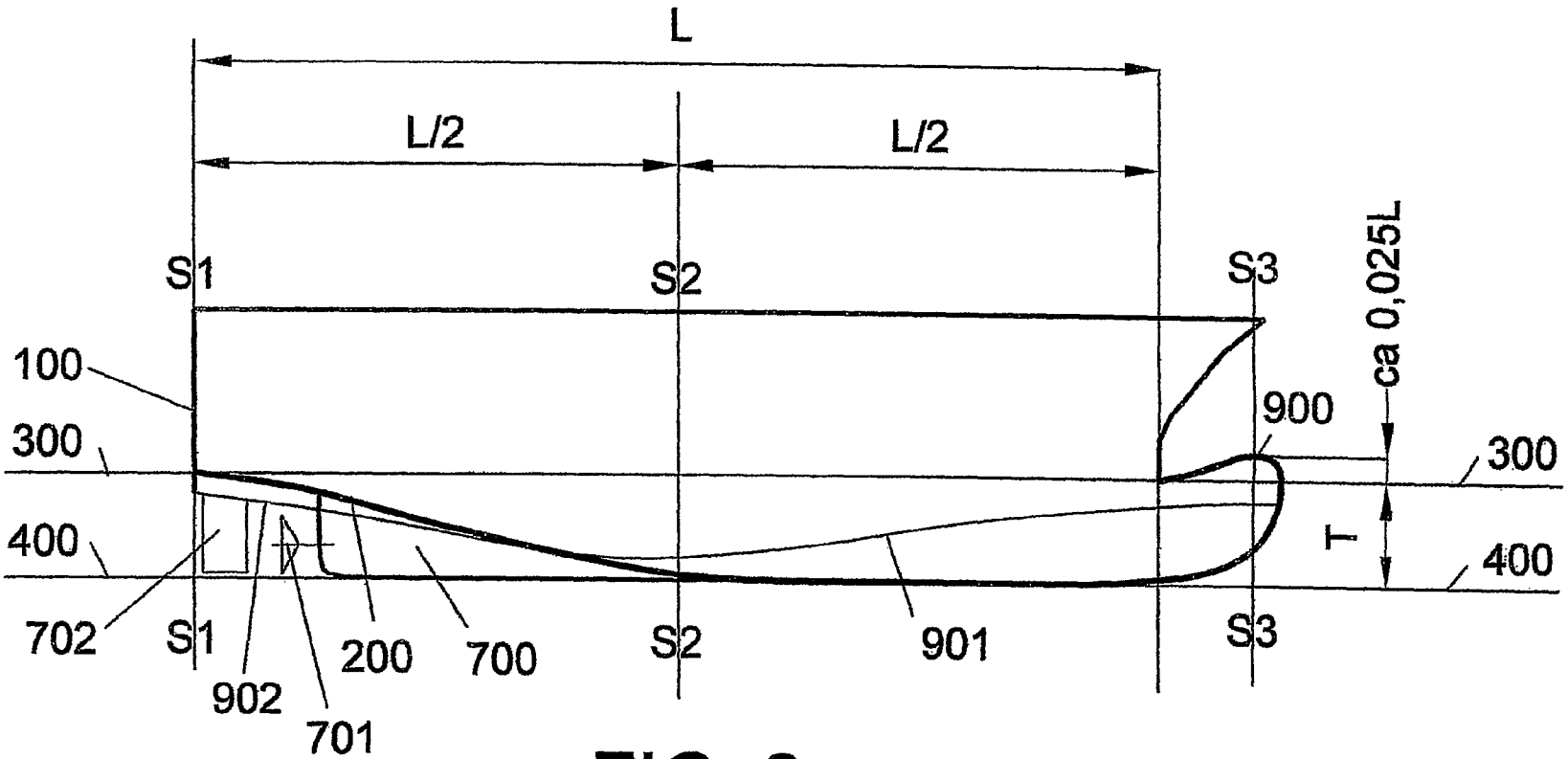
FIG. 2 shows a longitudinal section of the hull shown in FIG. 1.
Figure 3:
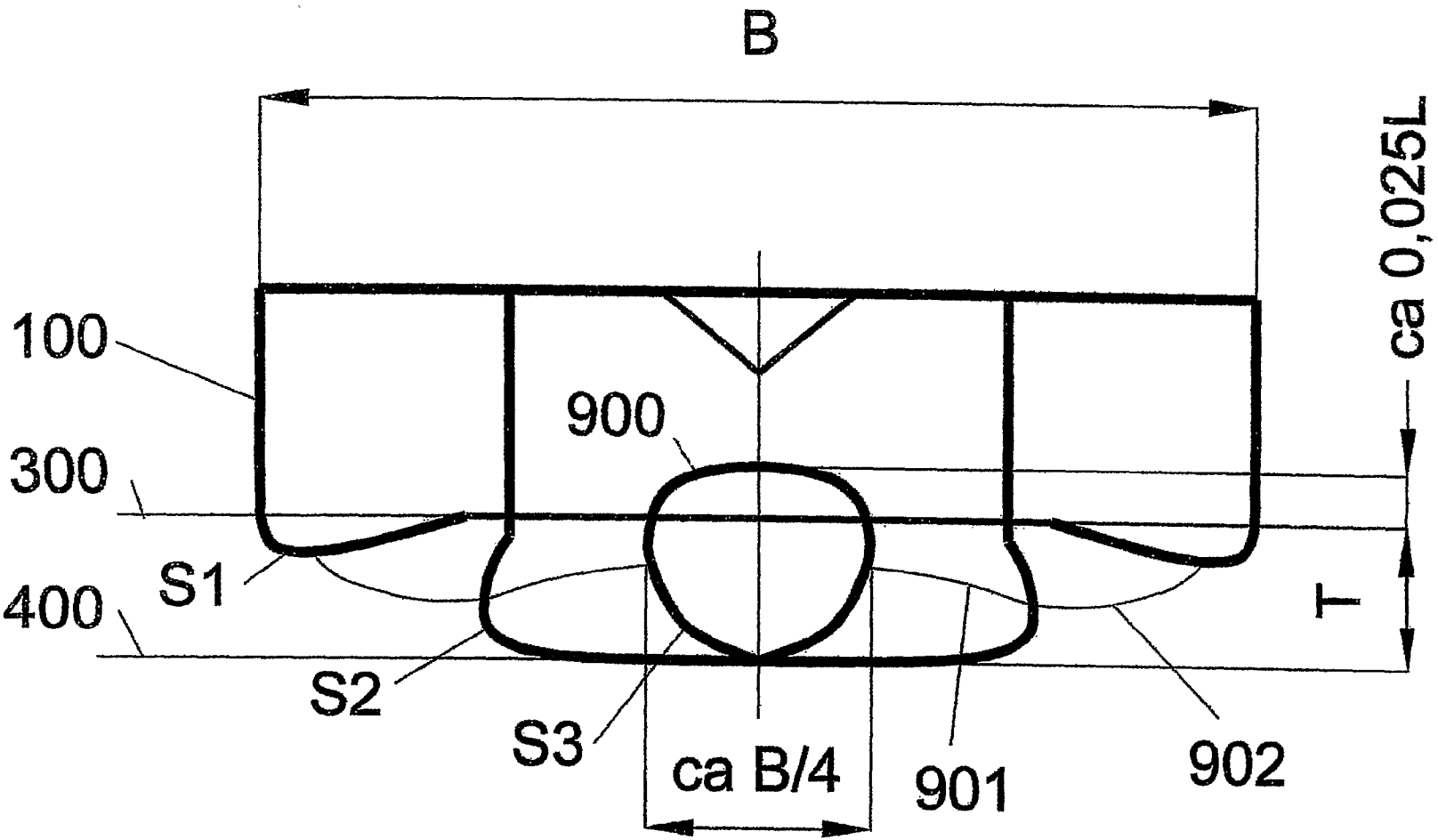
FIG. 3 is a transversal cross sectional view of the hull shown in FIG. 1 and FIG. 2.

The invention relates to making a considerable increase in the beam of the hull form as shown by the waterline 602 and width B2, whilst no change is made to the draught T of the hull at design waterline 300, so that B/T ratio is correspondingly increased. Reference is made to FIG. 2 and FIG. 3. During experiments with models having the new hull shape it has been proven that the specific resistance in the sea at the same speed is largely unaltered in relation to known Ramform™ hulls. At the same time the dampening effect on rolling is increased remarkably, so that angles of roll and vertical and lateral acceleration values are reduced compared with prior art Ramform™ designs.

The dampening is achieved by the wide after-ship in the preferred embodiment, increasing the added mass that rolls with the ship so that the mass of the hull plus the added mass rolling with it affect both the natural rolling frequency of the hull and its reaction to surrounding waves. This is explained in more details below when referring to FIGS. 5 and 6.

The geometrical changes described above will as stated give altered ratios between the beam B2 of the new hull shape and the design draught T. The relationship is changed in accordance with the invention from the prior art and applied values BIT in the region of 5.5-6.5 to newly preferred values from about 10 to approximately 12.

The measured dampening effect on rolling resulting from the substantially modified full form described herein is increased in standard experiments using models from approximately 1.5 in earlier designs to about 2.25 in the modified design, where the ratios (1.5 and 2.25 respectively) are defined as the natural rolling frequency of the hull configuration in air and in water respectively and they express the extent of the added mass rolling with the hull, with associated viscous damping, in the movements mentioned. More follows below in connection with FIGS. 5 and 6.

Reference is now made to FIG. 2. This Figure shows a longitudinal section of the hull with the design waterline plane 300, the base plane 400, the sloping plane 200 and the skegs 700 for directional stability and the preferred arrangement of propulsion units, each with its own propeller 710. A rudder is drawn at 702. Also shown (see FIG. 3 as well) is the top of the converging bulges that create the bulb member 900, the contour curve 910 that shows the approximate position of the maximum extent of the bulge in the forward part of the ship and the curve 902 that roughly indicates the maximum extent of the bulge from the sloping plane 200 in the after ship. Moreover, three positions S1, S2, and S3 are shown for the transverse cross-sections included in FIG. 3.

The three cross-sections S1, S2, and S3 shown in FIG. 3 show the progression of the bulges, where the bulges in the forward part of the ship, shown by the curve 901, are on the whole orientated horizontally and outwards, whilst aft from around L2 and indicated by the curve 902, they are gradually twisted downward, until at the outer edges of the transom stern 100 where they are directed downwards from the sloping plane 200, without the horizontal extent of the bulges exceeding the maximum width of the hull configuration, and without the vertical projection going down further than the base plane 400.

As mentioned above the bulges converge in a bulb member 900 that breaks through the design waterline 300 and terminates at a height of about 0.025 L above the design waterline, while the maximum width of the bulb member is preferably around B/4.

This high placement of the bulb member is in close relationship with the large beam of the hull at the aft end. Under way this hull form will have a tendency to give an increased forward trim, so that the bulb member is brought down below the surface of the sea to the most favorable depth in terms of resistance.

Figure 4:
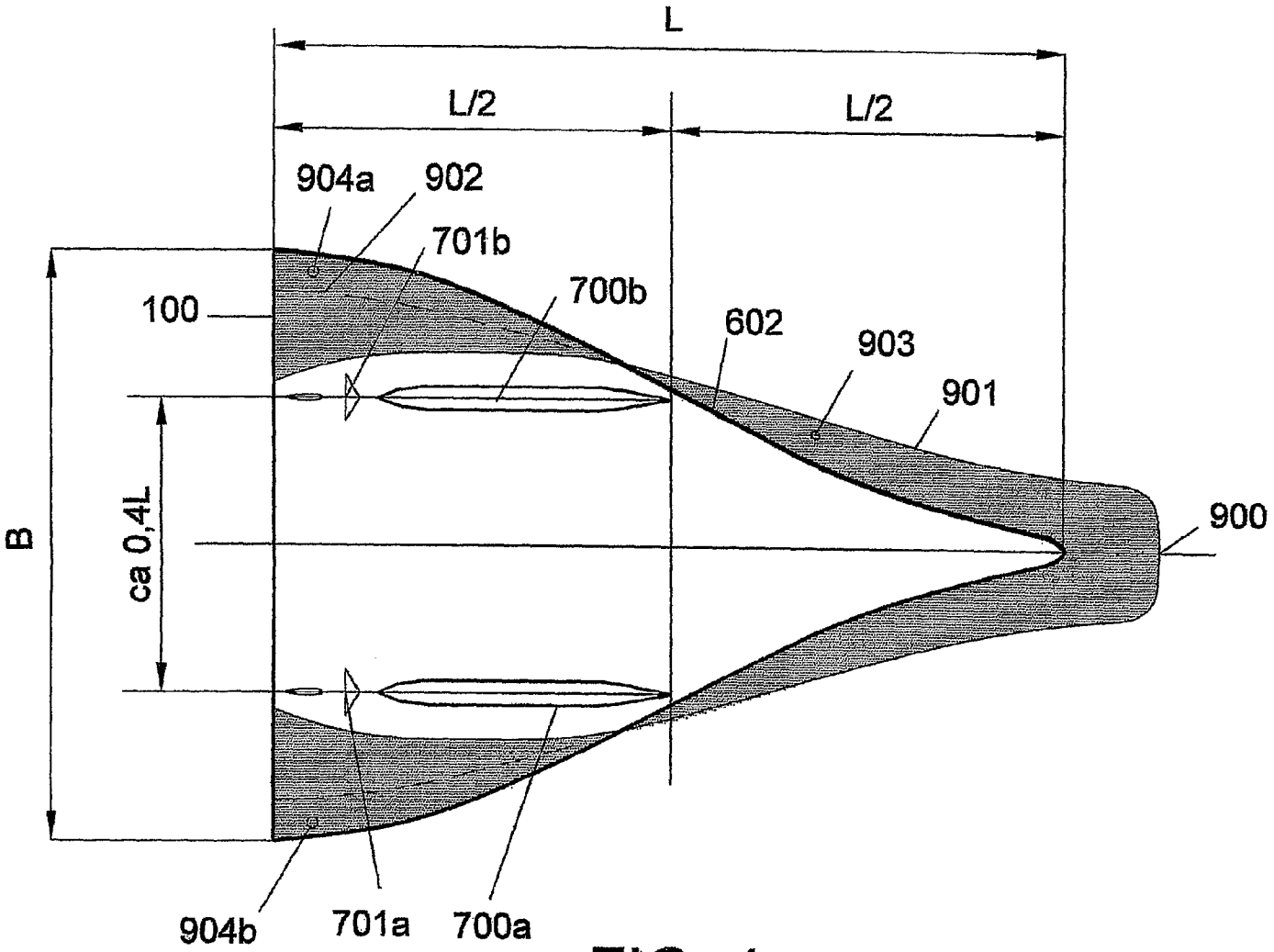
FIG. 4 is a plan view showing the bulge and the skegs with the propulsion units.

Reference is now made to FIG. 4. This Figure shows the location of the bulges on the hull and how the bulges 903 are rotated from an essentially vertical orientation of the bulges 904*a* and 904*b* at the aft end of the shift within the beam B and the base plane 400.

A significant advantage that emerges from the new geometry according to the invention is considerably improved maneuverability, which is achieved by a propulsion arrangement as shown in FIG. 4. This consists of qty. 2 symmetrically placed skegs, 700*a* and 700*b*, which can provide space for propulsion machinery, preferably at a lateral distance of about 0.4 L from one another, i.e. a significant proportion of the length L and beam B. Propulsion is achieved in the normal way with two propellers, 701*a* and 701*b*.

Figure 5:
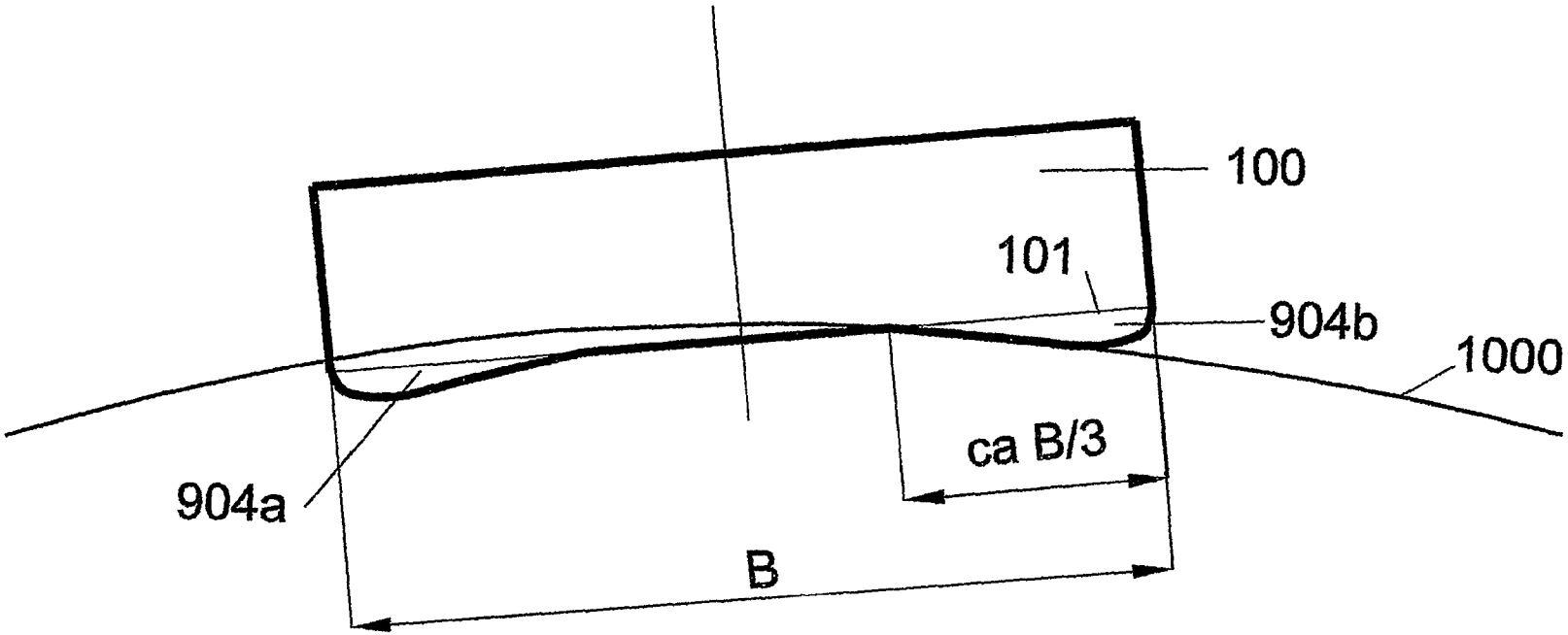
FIG. 5 shows a situation illustrating the contact between the transom stern and the sea surface.

Reference is now made to FIG. 5. This Figure represents a situation where the transom stern 100 forms a tangent to a wave top 1000 and demonstrates how the design of the bulges 904*a* and 904*b* in the after part of the ship contribute to the hull maintaining contact with the surface of the sea 1000 in a seaway, thus increasing the damping effect on the rolling movements of the hull configuration. In the example shown line 101 comprises the waterline contact for the wide hull that would be lost if it was without bulges 904*a* and 904*b*, around 30% of the beam B of the transom stern 100, with associated reduced viscous damping and less added water mass rolling with the hull.

Figure 6:
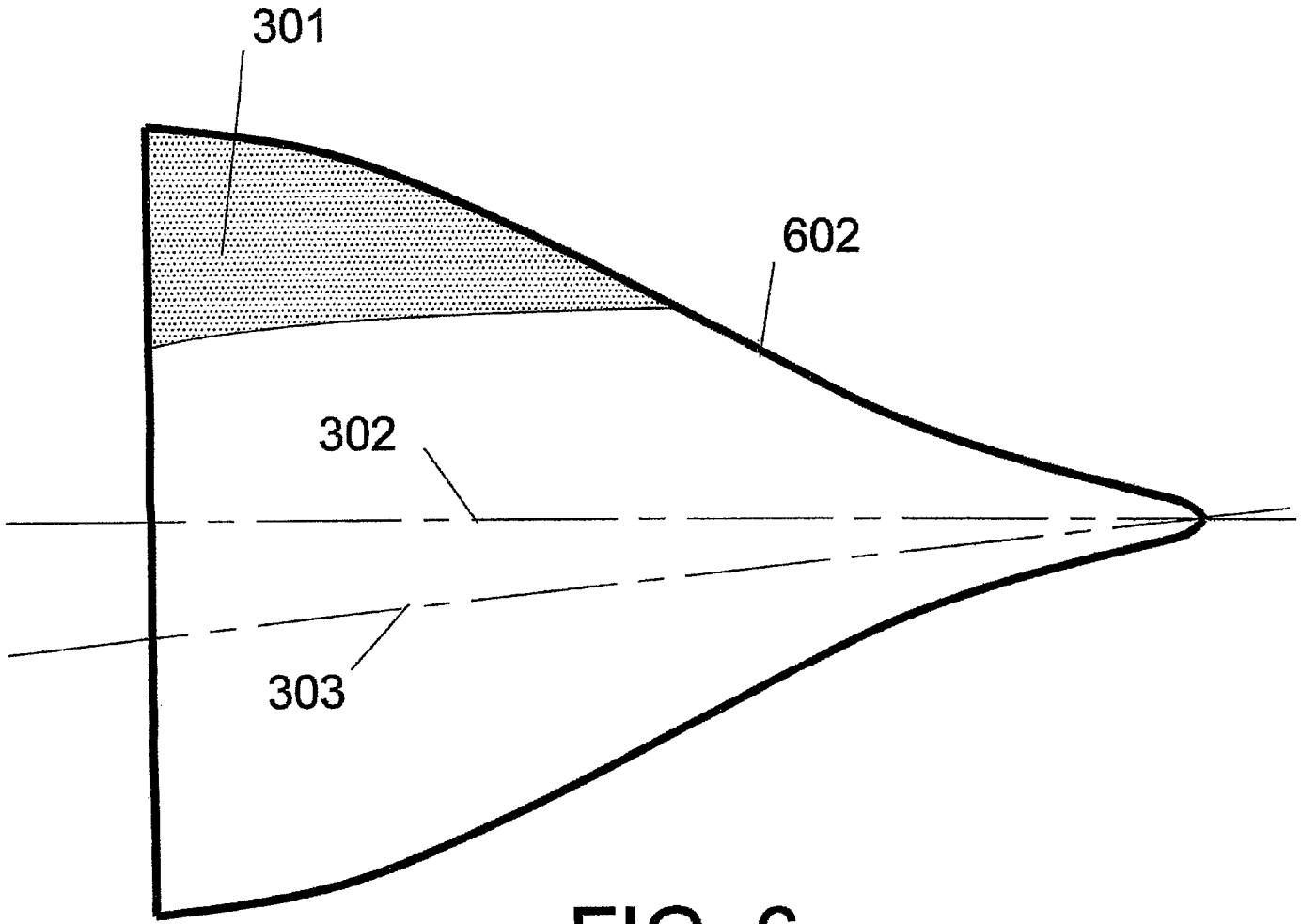
FIG. 6 serves to illustrate important conditions that apply to the rolling movement of a ship in a seaway.

FIG. 6 shows the waterline plane in the situation in FIG. 5, where the shaded area 301 marks the lost waterline area (corresponding to line 101 in FIG. 5) for a hull form without bulges. It also shows how the symmetry line 302 in accordance with the rolling movement, temporarily is displaced and turned to a position 303 with associated increasing movement in a seaway.

The invention claimed is:

1. A ship of a displacement type that has a transom stern, a longitudinal length L in a design waterline plane, a base plane parallel with the design waterline plane at a distance T corresponding to a design draught of the hull and comprising essentially sinusoidal waterlines, a sloping plane that comprises a bottom in an aft end of the ship and which extends from the transom stern at the design waterline plane to the base plane at approximately L/2, and a bulge on each side and along a part of the length of the hull, terminating at a forward end of the hull ahead of the length L in a tongue shaped bulb member, wherein a relationship between a maximum beam B and the design draught T is more than 7, and where the bulges form the bulb member and aft towards L/2 have a transversal, horizontal orientation from the surface of the hull and which from about L/2 rotate gradually downward 90 degrees into a vertical orientation, so that the bulge at the transom stern lies below a sloping plane and along the outer edges of the sloping plane, but within the maximum beam B and above the base plane.

2. A ship according to claim 1, wherein the tongue shaped bulb member breaks through the design waterline plane to a height above the design waterline plane.

3. A ship according to claim 1, wherein the width of the tongue shaped bulb member comprises a part of the beam B of the hull configuration, the part of the beam B being about B/4.

4. A ship according to claim 1, wherein an arrangement of symmetrically placed steering skegs is located below the sloping plane.

5. A ship according to claim 1, wherein the relationship between a maximum beam B and the design draught is between 10 and 12.

6. A ship according to claim 2, wherein tongue shaped bulb member breaks through the design waterline to a height of about 0.025 L above the design waterline plane.

7. A ship according to claim 4, wherein the steering skegs include propulsion units with a lateral distance between them that is a proportion of the length L of the hull and beam B respectively, thus approximately 0.4 L.

* * * * *